US010815048B2

(12) United States Patent
Bray et al.

(10) Patent No.: US 10,815,048 B2
(45) Date of Patent: Oct. 27, 2020

(54) PACK OF TOBACCO INDUSTRY PRODUCTS INCLUDING AN ADHESIVE-FREE REGION

(71) Applicant: British American Tobacco (Investments) Limited, London (GB)

(72) Inventors: Andrew Jonathan Bray, London (GB); Gary Fallon, London (GB); Paul Gibson, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 16/293,942

(22) Filed: Mar. 6, 2019

(65) Prior Publication Data

US 2019/0193925 A1 Jun. 27, 2019

Related U.S. Application Data

(63) Continuation of application No. 15/533,177, filed as application No. PCT/GB2015/053593 on Nov. 25, 2015, now Pat. No. 10,266,336.

(30) Foreign Application Priority Data

Dec. 5, 2014 (GB) ..... 1421707.9

(51) Int. Cl.
*B65D 85/10* (2006.01)
*B65B 19/12* (2006.01)
(Continued)

(52) U.S. Cl.
CPC ..... *B65D 85/1045* (2013.01); *B65B 19/12* (2013.01); *B65B 19/22* (2013.01);
(Continued)

(58) Field of Classification Search
CPC ..... B65B 19/12; B65B 19/22; B65B 51/02; B65B 61/06; B65D 65/40; B65D 75/04;
(Continued)

(56) References Cited

U.S. PATENT DOCUMENTS 8,783,454 B2 * 7/2014 Igo ..... B65D 75/5838 206/242
9,359,124 B2 * 6/2016 Lutzig ..... B65D 5/662
(Continued)

FOREIGN PATENT DOCUMENTS

EP 2243716 A1 10/2010
GB 2543264 A * 4/2017 ..... B65D 85/1045
(Continued)

OTHER PUBLICATIONS

International Search Report for corresponding application PCT/GB2015/053593 filed Nov. 25, 2015; dated Feb. 5, 2016.
(Continued)

*Primary Examiner* — Bryon P Gehman
(74) *Attorney, Agent, or Firm* — Cantor Colburn LLP

(57) ABSTRACT

A pack having a group of tobacco industry products wrapped in a laminate to form a bundle is disclosed. The pack has a base containing the bundle, and a lid mounted to the base for rotation between open and closed positions. The laminate has an outer layer having a first cut that defines an outer layer region bounded by said first cut and, an inner layer having a second cut that defines an inner layer region bounded by said second cut. The inner layer region lies within the outer layer region. A part of the outer layer region is attached to an inside surface of the lid such that, as the lid is rotated into its open position, the inner and outer layer regions are lifted causing the inner and outer layers to delaminate in a peripheral region between the first and second cuts and an opening to be created in the laminate.

17 Claims, 11 Drawing Sheets

(51) Int. Cl.

| | |
|---|---|
| ***B65B 19/22*** | (2006.01) |
| ***B65B 51/02*** | (2006.01) |
| ***B65B 61/06*** | (2006.01) |
| ***B65D 65/40*** | (2006.01) |
| ***B65D 75/04*** | (2006.01) |
| ***B65D 75/58*** | (2006.01) |
| ***B65D 77/02*** | (2006.01) |

(52) U.S. Cl.
CPC ..... *B65B 51/02* (2013.01); *B65B 61/06* (2013.01); *B65D 65/40* (2013.01); *B65D 75/04* (2013.01); *B65D 75/5855* (2013.01); *B65D 77/02* (2013.01); *B65D 2575/586* (2013.01)

(58) Field of Classification Search
CPC .... B65D 75/5855; B65D 77/02; B65D 85/10; B65D 85/1045; B65D 2575/586
USPC ..... 206/245
See application file for complete search history.

(56) References Cited

U.S. PATENT DOCUMENTS 9,499,331 B2 * 11/2016 Seyfferth De Oliveira ..... B65D 85/1045
9,533,821 B2 * 1/2017 Buse ..... B65B 19/025
9,714,134 B2 * 7/2017 Tacchi ..... B65D 85/1036
9,788,575 B2 * 10/2017 Buse ..... B65B 19/226
9,993,985 B2 * 6/2018 Beutler ..... B65D 85/1045
2015/0151872 A1 * 6/2015 Schofield ..... B65D 65/40 229/5.84

FOREIGN PATENT DOCUMENTS

WO 2005123535 A1 12/2005
WO 2088142540 A1 11/2008
WO 2011009520 A1 1/2011
WO 2012147073 A1 11/2012
WO 2013098109 A1 7/2013
WO 2013120913 A1 8/2013
WO 2013120915 A1 8/2013
WO 2013120916 A1 8/2013
WO 2014006223 A1 1/2014

OTHER PUBLICATIONS

Written Opinion for corresponding application PCT/GB2015/053593 filed Nov. 25, 2015; dated Feb. 5, 2016.

* cited by examiner

PACK OF TOBACCO INDUSTRY PRODUCTS INCLUDING AN ADHESIVE-FREE REGION

CROSS REFERENCE TO RELATED APPLICATIONS

This application is a continuation of U.S. patent application Ser. No. 15/533,177 filed on Jun. 5, 2017 under 35 U.S.C. 371 as the national stage of International Patent Application Number PCT/GB2015/053593 which was filed on Nov. 25, 2015 claiming priority to United Kingdom Patent Application Number 1421707.9 filed on Dec. 5, 2014, all of which said applications are herein incorporated by reference in their entirety.

FIELD

The present invention relates to a pack of tobacco industry products such as smoking articles.

BACKGROUND

Cigarettes packs comprise a carton made from cardboard which has a base and a hinged lid. The base contains a bundle of cigarettes that are wrapped in a flexible barrier material that defines an extraction opening to facilitate removal of the cigarettes from the pack when the lid is open. An adhesive label may be attached to a portion of the flexible barrier material that defines the extraction opening. The label is attached to, and has a periphery that extends beyond, the portion of the barrier material defining the extraction opening so that the portion is withdrawn together with the label when the label is peeled back, thereby forming the extraction opening. The extraction opening may be reclosed by lowering the label so that the portion of the barrier layer relocates in the extraction opening and the periphery of the adhesive label attaches to the barrier material surrounding the extraction opening.

SUMMARY

In accordance with embodiments of the invention, there is provided a pack comprising a group of tobacco industry products wrapped in a laminate to form a bundle, a base containing the bundle, and a lid mounted to the base for rotation between open and closed positions, the laminate comprising an outer layer having a first cut that defines an outer layer region bounded by said first cut, and an inner layer having a second cut that defines an inner layer region bounded by said second cut, the inner layer region lying within the outer layer region, wherein a part of the outer layer region is attached to an inside surface of the lid such that, as the lid is rotated into its open position, the inner and outer layer regions are lifted causing the inner and outer layers to delaminate in a peripheral region between the first and second cuts and an opening to be created in the laminate.

The laminate may comprise a pressure-sensitive adhesive between the inner and outer layers such that said peripheral region readheres when the lid is rotated into its closed position.

A portion of the laminate corresponding to the part of the outer layer region that is attached to the inside surface of the lid may be free of pressure sensitive adhesive.

The bundle may comprise an edge over which the first and second cuts extend such that the opening is formed over said edge. A region of the laminate corresponding to said edge may be free of pressure sensitive adhesive.

The inner and outer layer regions may be attached using a region of permanent adhesive.

The permanent adhesive attaching the inner and outer layer regions may be patterned to include a zig-zag profile extending in a direction towards the second cut.

In a first example, an outer surface of the outer layer region may be attached to the inside surface of the lid.

In a second example, the part of the outer layer region that is attached to the inside surface of the lid may be folded to form a tab and an inner surface of said tab is attached to the inside surface of the lid.

The outer layer region may comprise a fold line along which the tab can flex relative to the remainder of said outer layer region.

The inner and outer layers may comprise orientated polypropylene.

The laminate may comprise a third layer, disposed between said inner and outer layers, and wherein either the first cut or the second cut extends through the third layer.

The third layer may comprise metal foil.

In one example, the part of the outer layer region that is attached to an inside surface of the lid may be arranged such that the inner and outer layer regions that are lifted when the pack is opened form an outwardly convex shape.

In another example, the part of the outer layer region that is attached to an inside surface of the lid may be arranged such that the inner and outer layer regions that are lifted when the pack is opened form an inwardly concave shape.

The first and second cuts may be formed by lasers.

In accordance with embodiments of the invention, there is also provided a method of producing a pack comprising the steps of:

- wrapping a laminate about a group of tobacco industry products to form a bundle, said laminate comprising inner and outer layers, the outer layer having a first cut that defines an outer layer region, and the inner layer having a second cut that defines an inner layer region that lies within the outer layer region;
- inserting said bundle within a base having a lid mounted to the base for rotation between open and closed positions; and
- attaching a part of the outer layer region to an inside surface of the lid.

The method may further comprise the step of cutting the laminate to define the first and second cuts prior to wrapping the laminate about the group of tobacco industry products.

The cutting may be performed using a laser.

The step of attaching a part of the outer layer region to an inside surface of the lid may comprise providing said part with an adhesive coating prior to folding a blank about the bundle to form the lid.

BRIEF DESCRIPTION OF THE DRAWINGS

Embodiments of the invention will now be described, by way of example only, with reference to the accompanying drawings, in which.

DETAILED DESCRIPTION

Figure 1:
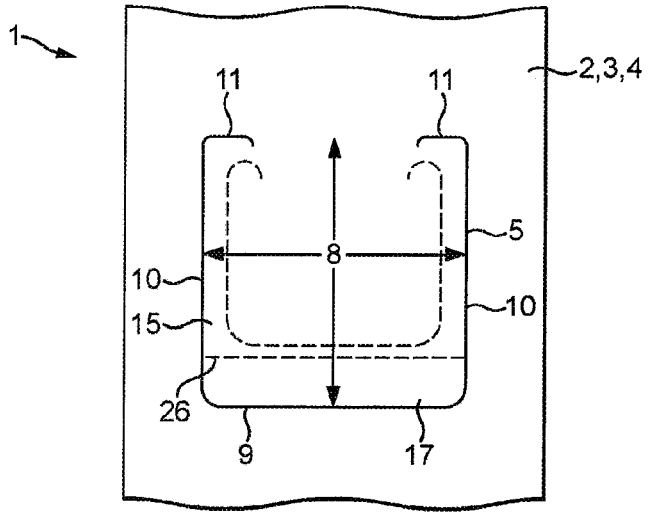
FIG. 1 shows a first side of a wrapper.

The various examples of barrier material or wrappers described hereinafter are for forming a wrapped bundle by wrapping the wrapper around a group of articles, such as a group of tobacco industry products, such as cigarettes. The wrappers comprise a laminate material having a series of cuts to enable an opening to be formed in the laminate material for extracting cigarettes from the wrapped bundle. The cuts further define a cover flap, which is integrally formed from one or more of the layers of the laminate of the wrapper, that can be used to re-cover the opening that is formed. The wrapped bundle is received in a hinged-lid pack and a part of the laminate material is attached to the lid such that opening and closing the lid simultaneously opens and closes the cover flap.

Forming the opening and the cover flap from cuts made in the laminate material obviates the need to provide a separate covering label to cover the opening. This simplifies the manufacturing process because a further step of applying a separate label is not needed. Moreover, as there is no separate label other than the label formed from a part of the laminated wrapper itself, there are no problems associated with alignment of a separate label to other features of the packaging. The lack of additional label also reduces the amount of material required for the packaging, which can reduce the cost and environmental impact.

As described in more detail with reference to FIGS. 4A and 4B, the laminate material 2 forming the barrier material or wrapper has two or more layers. In the embodiments described herein the laminate material 2 of the wrapper 1 has a first, inner layer 3 and a second, outer layer 4 such that, when the wrapper is wrapped about a group of cigarettes, the first layer 3 is disposed on the outside of the wrapped bundle 22 facing away from the cigarettes, and the second layer 4 is on the inside of the wrapped bundle 22 facing toward the cigarettes.

The laminate material 2 is provided with a first cut 5 in the outer layer 3 and a second cut 6 in the inner layer 4. The first and second cuts 5, 6 shown in the accompanying drawings are either shown as a solid line, if the cut is in the layer of the laminate material 2 on the side illustrated, or as a dotted line, if the cut is in the layer of the laminate material 2 on the opposite side to that illustrated.

Figure 2:
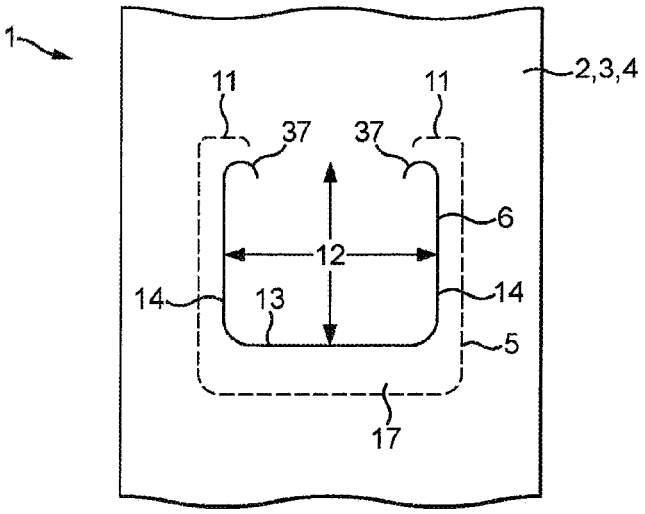
FIG. 2 shows the opposite side of the wrapper of FIG. 1.

FIG. 1 shows a wrapper 1 from the side of the outer layer 3 of the laminate material 2. FIG. 2 shows the same wrapper 1 from the side of the inner layer 4 of the laminate material 2.

Referring to FIGS. 1 and 2, a first cut 5 is made in the outer layer 3 of the laminate material 2. The first cut 5 extends through or substantially through the outer layer 3 of the laminate material 2. The first cut 5 does not extend into the inner layer 4 of the laminate material 2.

The first cut 5 in the laminate material 2 delimits a first region 8 in the outer layer 3, as indicated in FIG. 1. The first cut 5 has a bottom edge 9, opposing side edges 10 and a partial top edge 11 that extends from the opposing side edges 10. Therefore, the first region 8 of the outer layer 3 remains attached to the remainder of the outer layer 3 of the laminate material 2 across the top edge 11, which acts as a hinge when the wrapper 1 is opened as described hereinafter.

A second cut 6 is made in the inner layer 4 of the laminate material 2. The second cut 6 extends through or substantially through the inner layer 4 of the laminate material 2. The second cut 6 does not extend into the outer layer 3 of the laminate material 2.

The second cut 6 in the laminate material 2 delimits a second region 12 in the inner layer 4, as indicated in FIG. 2. The second cut 6 has a bottom edge 13 and opposing side edges 14 that are parallel to and offset from the bottom edge 9 and opposing side edges 10 of the first cut 5, respectively. The second cut also comprises rounded ends 37 at the ends of the opposing side edges 14. The rounded ends 37 are proximate to the partial top edge 11 of the first cut 5.

The second cut 6 is offset relative to the first cut 5, such that the second cut 6 is disposed entirely within a boundary defined by the first cut 5. Therefore, the second region 12 is smaller than, and disposed within, the first region 8. That is, the edges 13, 14 of the second cut 6 are inwardly offset from the edges 9, 10, 11 of the first cut 5 so that the cuts 5, 6 formed within the laminate material 2 are spaced from each other to define a peripheral region 15 between the first and second cuts 5, 6.

As with the first region 8 of the outer layer 3 of the laminate material 2, the second region 12 of the inner layer 4 remains attached to the remainder of the inner layer 4 of the laminate material 2 across a top edge, which is in line with the rounded ends 37 of the second cut 6.

A bottom part of the outer layer 3 defined by region 8 forms a tab region 17 in the outer layer 3. The tab region 17 is located adjacent to the bottom edge 9 of the first cut 5.

Figure 3:
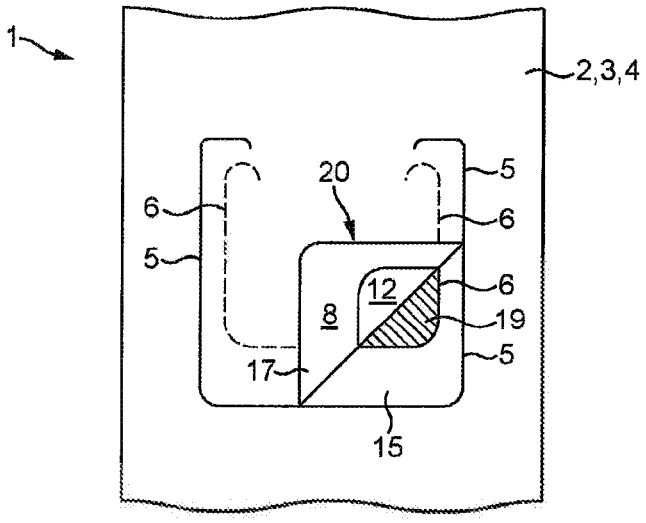
FIG. 3 shows the wrapper of FIGS. 1 and 2 in a partially open position.

FIG. 3 shows the wrapper 1 of FIGS. 1 and 2 from the side of the outer layer 3 of the laminate material 2. As shown, when the first and second regions 8, 12 of the laminate material 2 are lifted they separate from the remainder of the laminate material 2 along the first and second cut lines 5, 6. In this way, the first and second regions 8, 12 of the laminate material 2 are lifted away from the remainder of the laminate material 2 to form a cover flap 20 and an opening 19.

Where the first and second areas 8, 12 overlap, i.e. within the second region 12, the inner and outer layers 3, 4 remain attached due to the bond between them. In the peripheral region 15, between the first and second cuts 5, 6, the inner and outer layers 3, 4 of the laminate material 2 delaminate or become separated.

Therefore, the boundary of the opening 19 that is created in the laminate material 2 when the first and second regions 8, 12 are lifted is defined by the second cut 6.

When opened, the first and second regions 8, 12 of the laminate material 2 form a cover flap 20 that can be repositioned to close the opening 19.

In the present example, pressure-sensitive or 're-stick' adhesive is provided between the inner and outer layers 3, 4 of the laminate material 2. Therefore, when the cover flap 20 is repositioned over the opening 19 the inner and outer layers 3, 4 will reattach in the peripheral region 15, where delamination had occurred.

Preferably, the pressure sensitive adhesive is provided to the outer layer 3, so that on opening the pressure sensitive adhesive remains on the outer layer 3 and not on the inner layer 4, and is not split between the outer and inner layers 3, 4. In this way, the pressure sensitive adhesive remains on the cover flap 20 and the peripheral region of the inner layer 4, which extends around the opening 19, is substantially adhesive free.

In other examples, a single-use, but releasable, adhesive may be provided between the inner and outer layers 3, 4 of the laminate material 2. In this way, when closed, the cover flap 20 will still be repositioned over the opening 19 but will not be re-adhered to the laminate material 2.

The above-described combination of offset first and second cuts 5, 6 in different layers of the laminate material 2 provide a labyrinth seal through which fluids, such as air or other gasses, or liquids, or vapours are prevented, or substantially prevented, from passing. That is, a fluid would have to pass through one of the first or second cuts 5, 6, then between the layers 3, 4 of the laminate 2, through the adhesive provided in that region, and then through the other cut 5, 6. This arrangement therefore ensures that the wrapper 1 provides an effective barrier both prior to first opening and after re-closing.

In each of the above described embodiments, the tab region 17 may optionally be provided with a fold line 26, as indicated in FIG. 1. In particular, the tab region 17 may be separated from the remainder of the first region 8 by a fold line 26. The fold line 26 may comprise a score line, a line of perforations, or other weakening that provides a line along which the outer layer 3 can more readily flex relative to the remainder of the laminate material 2. However, it will be appreciated that the laminate material 2 itself is a flexible material, so the fold line 26 is an optional feature that would help control where the laminate material 2 flexes.

Figure 4A:
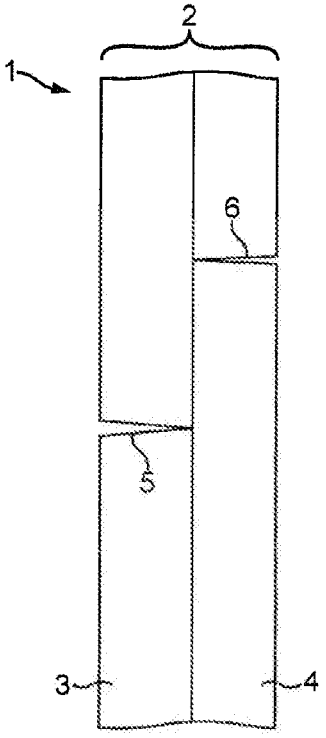
FIGS. 4*a* and 4*b* show partial cross-sections of the wrapper of FIGS. 1 to 3, having different laminate materials.
Figure 4B:
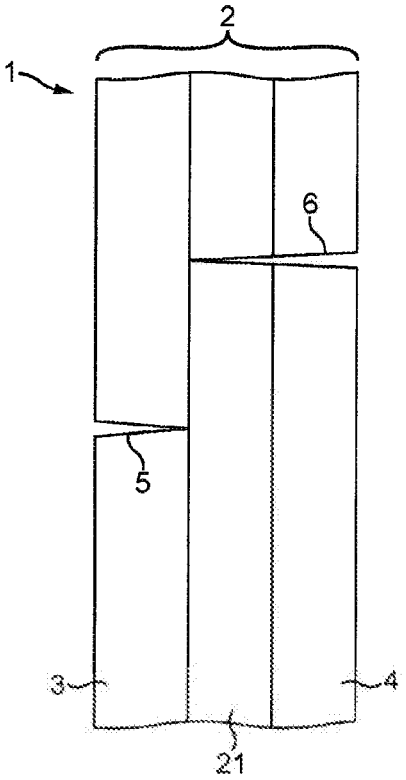

FIGS. 4A and 4B show partial cross-sections of the wrappers 1 described with reference to FIGS. 1 to 3 above, but which have different laminate materials 2.

FIG. 4A shows a cross-section of a wrapper 1 with a laminate material 2 having two layers, as specifically described with reference to the examples of FIGS. 1 to 3. That is, the laminate material 2 has an outer layer 3 which is bonded (laminated) to an inner layer 4.

A first cut 5 is provided in the outer layer 3, and a second cut 6 is provided in the inner layer 4, the first and second cuts 5, 6 are offset as previously described.

As indicated in FIG. 4A, the previously described peripheral region 15, between the inner and outer layers 3, 4, is defined between the first and second cuts 5, 6.

As shown, the arrangement of the offset first and second cuts 5, 6 provides a labyrinth barrier through which a substance would have to travel in order to enter or leave a wrapped bundle formed using the wrapper 1.

FIG. 4B shows an alternative example of a wrapper 1 having a laminate material 2 with an outer layer 3, an inner layer 4, and a third layer 21. The third layer 21 is disposed between the inner and outer layers 3, 4, and the inner and outer layers 3, 4 are bonded (laminated) to opposing sides of the third layer 21.

In the illustrated example, the outer layer 3 and the third layer 21 are bonded using a pressure-sensitive 're-stick' adhesive, and the inner layer 4 and the third layer 31 are bonded using a permanent adhesive. The first cut 5 is provided in the outer layer 3, and the second cut 6 is provided in both the inner layer 4 and in the third layer 21. The first and second cuts 5, 6 are offset as previously described.

As indicated in FIG. 4B, in this example the peripheral region 15 between the first and second cuts 5, 6 is formed between the outer layer 3 and the third layer 21. It will be appreciated that in this example the inner and outer layers 3, 4 in the peripheral region 15 will be reattached to each other on closing the cover flap 20, although in this case the third layer 21 is disposed in between such that the outer layer 3 is attached directly to the third layer 21 and therefore indirectly to the inner layer 4.

In an alternative example similar to that of FIG. 4B, the outer layer 3 and the third layer 21 are permanently bonded together, and the inner layer 4 and the third layer 21 are bonded together using pressure-sensitive adhesive. In this case, the first cut 5 is provided in the outer layer 3 and in the third layer 21, and the second cut 6 is provided in the inner layer 4 only. The first and second cuts 5, 6 are offset as previously described.

It will be appreciated that the laminate material 2 may have more than three layers bonded together in a similar manner to that described above, with the first and second cuts 5, 6 each provided in one or more of the layers.

Each layer may comprise one or more of a polymer, an orientated polymer, a metal foil, for example an aluminium foil, a metallised polymer, or other similar flexible materials for use as packaging.

The layers may be permanently bonded together using a permanent adhesive, that is, an adhesive that strongly bonds the layers together such that the layers do not separate when the wrapper is opened or closed.

The pressure-sensitive adhesive allows layers of the laminate material 2 to be reattached to each other after delamination. The pressure sensitive adhesive is a non-drying, permanently tacky adhesive, such that the pressure sensitive adhesive can be used multiple times to detach and reattach the layers of the laminate material 2 in the peripheral region 15.

In a preferable example, the laminate material 2 comprises three layers, the inner and outer layers 3, 4 being made of orientated polypropylene (OPP) and the third layer 21, disposed between the inner and outer layers 3, 4, is made of aluminium foil.

In examples, the OPP inner and outer layers 3, 4 have a thickness of between 10 microns and 50 microns.

In one example, the OPP layers preferably have a thickness of between 10 microns and 30 microns, more preferably approximately 20 microns. This has been found to provide an adequate seal for preventing ingress of fluids through the first and second cuts 5, 6.

In another example, the OPP inner and outer layers 3, 4 have a thickness of between 30 microns and 50 microns, more preferably approximately 40 microns. This has been found to provide sufficient rigidity in the laminate material 2 for repetitive opening and closing, while limiting material usage.

In examples, the aluminium foil has a thickness of between 5 microns and 20 microns, preferably between 5 microns and 15 micros, more preferably approximately 9 microns.

The first and second cuts 5, 6 can be formed in the laminate material 2 using a mechanical cutter with a limited, pre-determined, cutting depth. That is, the mechanical cutter is adapted to cut through the appropriate layers and not the others in the manner previously described. Such a process is known as die cutting or kiss cutting.

Alternatively, the first and second cuts 5, 6 can be formed using lasers. For example, a first laser can be configured to cut the outer layer 3 but not the inner layer 4 and a second laser can be configured to cut the inner layer 4 but not the outer layer 3. Either of the lasers can be configured to also cut the third layer 21. Therefore, the lasers can be configured to cut the layers of the laminate material 2 in any of the ways previously described, in particular with reference to FIGS. 4*a* and 4*b*.

In a preferred embodiment the laminate material 2 comprises inner and outer layers 3, 4 made of orientated polypropylene (OPP) and a third layer 21 made of metal foil, for example aluminium foil, as illustrated in FIG. 4*b*. In this case, a laser can be used to form the first and second cuts 5, 6.

A first laser, only capable of cutting through OPP, forms the first cut 5 in the outer layer 3 from the side of the outer layer 3. The first laser is not capable of cutting through the aluminium foil third layer 21, so the first cut 5 is limited to the outer layer 3.

A second laser, capable of cutting through aluminium foil, forms the second cut 6 in the inner layer 4 and third layer 21 from the side of the inner layer 4. When forming the second cut 6 the second laser beam passes through the inner layer 4, is incident on the third layer 21 (aluminium foil) which cuts the third layer 21, and some of the energy is reflected back towards the inner layer 4 which causes the inner layer 4 to also be cut. Therefore, the second laser will only form a cut in the third layer 21 and inner layer 4.

The first and second lasers can be configured in the above described manner by selecting an appropriate wavelength and power for the material to be cut—in this example orientated polypropylene and/or aluminium foil.

It will be appreciated that other packaging materials are also capable of being cut with lasers, and the above is merely a preferred embodiment. In particular, lasers can be configured with an appropriate wavelength and/or power to cut only through a single layer of OPP and not an adjacent layer of OPP. Therefore, laser cutting could also be used to provide the first and second cuts 5, 6 in the two layer laminate material 2 described with reference to FIG. 4*a*.

The first and second cuts 5, 6 in the laminate material 2 may each extend entirely through the relevant layer of the laminate material 2. Alternatively, the cuts 5, 6 may extend only partially through the relevant layer of the laminate material 2, and the remainder of that layer will tear on pulling the tab region 17 to form the opening. The polypropylene fibres can be orientated in the direction of such a tear to facilitate the tearing action.

Figure 5:
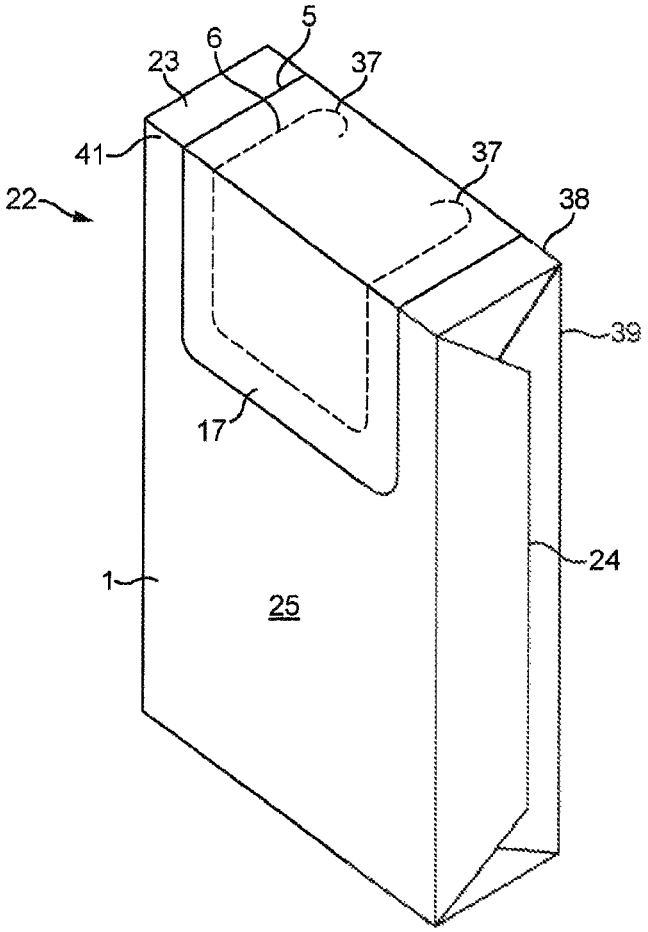
FIG. 5 shows a wrapped bundle formed from the wrapper of FIGS. 1 to 4*b;*

FIG. 5 shows a wrapped bundle 22 containing cigarettes that has been made by wrapping the above described wrapper 1 around a group of cigarettes. The cigarettes are elongate cylindrical articles arranged in a collation and then wrapped in the wrapper 1. As shown, the wrapper 1 has been folded about a group of cigarettes with first and second cuts 5, 6 extending from a front face 25 of the wrapped bundle 22, over a front edge 41, and onto one end face 23 of the wrapped bundle 2. That end face 23 of the wrapped bundle 22 corresponds to the ends of the cigarettes, so that cigarettes can be extracted lengthwise from the wrapped bundle 22 when the opening is formed (19, see FIG. 3). In particular, that end face 23 of the wrapped bundle 22 corresponds to the filter ends of the cigarettes so that the cigarettes can be extracted filter-first.

As shown, the rounded ends 37 of the second cut 6 may be positioned on the end face 23 of wrapped bundle 22, such that the opening 19 does not extend over the rear edge 38.

In another example, the second cut 6 extends over a rear edge 38 of the wrapped bundle 22 and onto the rear face 39 of the wrapped bundle 22, which is opposite to the front face 25. In this way, when the opening (19, see FIG. 3) is formed it extends over the entire end face 23 of the wrapped bundle 22.

It will be appreciated that the opening (19, see FIG. 3) will be formed to the extent of the rounded ends 37 (see FIG. 2) of the second cut 6.

In the example shown in FIG. 5, the ends 24 of the wrapper 1 have been folded against the sides of the group of cigarettes. These folded ends 24 can be sealed, for example using an induction sealing process, a heat sealing process, a fin sealing process or adhesive, to provide a sealed wrapped bundle 22 of cigarettes.

Figure 6:
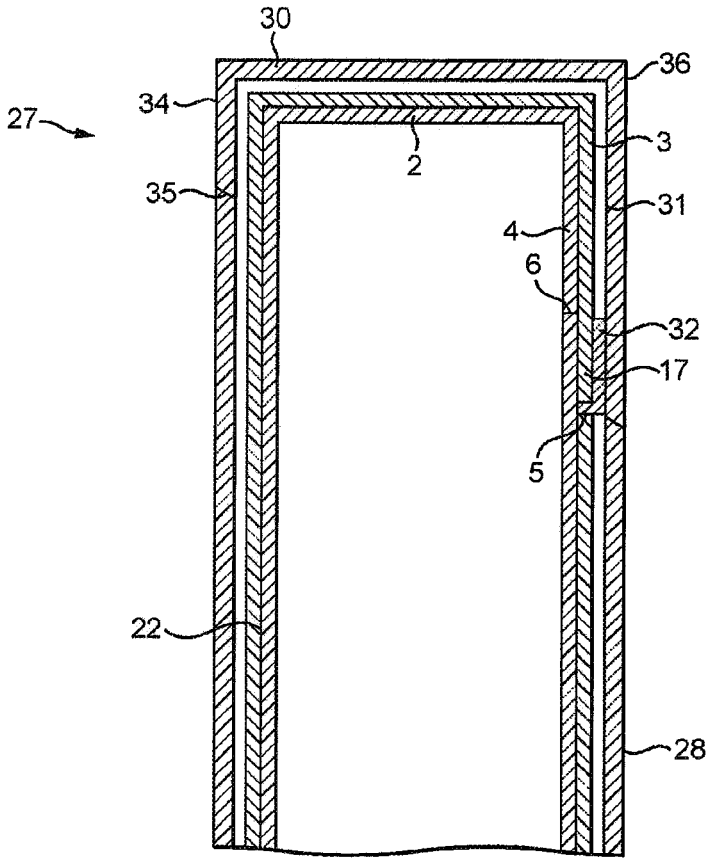
FIG. 6 shows a cross-section of a first example of a pack containing the wrapped bundle of FIG. 5, in a closed position.
Figure 7:
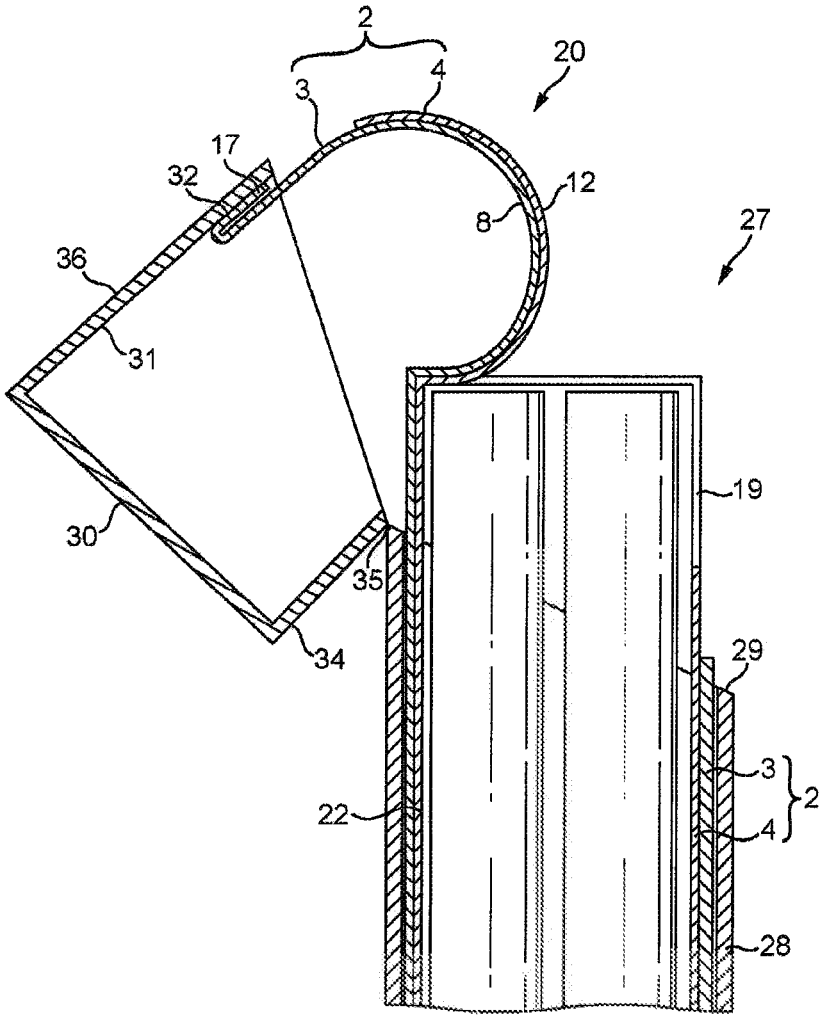
FIG. 7 shows another cross-section of the pack of FIG. 6, in an open position.

FIGS. 6 and 7 show a hinged-lid pack 27 that contains the wrapped bundle 22 of FIG. 5. The hinged-lid pack 27 comprises a base portion 28 in which the wrapped bundle 22 is received such that it protrudes from an open end 29 of the base portion 28. The pack 27 also has a lid 30 hingedly mounted to the base portion 28. In the closed position shown in FIG. 6 the lid 30 covers the protruding end of the wrapped bundle 22, and in the open position shown in FIG. 7, the protruding end of the wrapped bundle 22 is exposed and accessible.

In the example shown in FIGS. 6 and 7, a portion of the laminate material 2 is attached to an inside surface 31 of the lid 30. In this way, operating the lid 30 simultaneously operates the cover flap 20 on the wrapped bundle 22 to open and close the opening 19.

The lid 30 comprises a rear wall 34 which is hingedly mounted to the base 28 about a hinge 35. The lid 30 also has a front wall 36, opposite to the rear wall 34, to which the laminate 2 is attached.

In this example, as shown in FIG. 6, the tab region 17 of the outer layer 3 of the laminate 2 is directly adhered to the inside surface 31 of the lid 30 by adhesive 32. Therefore, when the lid 30 is rotated into the open position, as shown in FIG. 7, the lid 30 will pull the tab region 17 of the outer layer 3 and also the first and second regions 8, 12 of the inner and outer layers 4, 3 to form the opening 19.

In the open position, shown in FIG. 7, the tab region 17 has been folded back on itself as the lid 30 has been rotated into the open position. In this way, the cover flap 20, formed by the first and second regions 8, 12 of the laminate material 2, forms a convex shape that protrudes from the lid 30 in the open position, as shown. Therefore, as the lid 30 is opened the cover flap 20 will be gradually peeled off the remainder of the laminate material 2 and then gradually reattached as the lid 30 is closed.

If the laminate material 2 includes the optional fold line 26 (see FIG. 1) then the laminate material 2, in particular the outer layer 3, will be folded along that fold line 26 as the lid 30 is opened.

It will be appreciated that, in this example, the tab region 17 may not be folded back on itself along a line, as shown in FIG. 7, and may instead deform into an arc. This will depend on whether or not the laminate material 2 is provided with the optional fold line 26 shown in FIG. 1.

If the wrapper 1 is provided with pressure sensitive adhesive, as previously described, this gradual peeling action ensures that the layers of the laminate material 2 are reattached to each other in the peripheral region 15.

The pressure sensitive adhesive is arranged such that, after opening, the pressure sensitive adhesive remains on the outer layer 3 of the laminate material 3. That is, the pressure sensitive adhesive is provided to the outer layer 3 before the laminate material 2 is formed by applying the inner layer 4 (and any other layers) to form a laminate.

Therefore, when the cover flap 20 is reclosed, the outer and inner layers 3, 4 in the peripheral region 15 are readhered to each other by the pressure sensitive adhesive on the outer layer 3.

Figure 8:
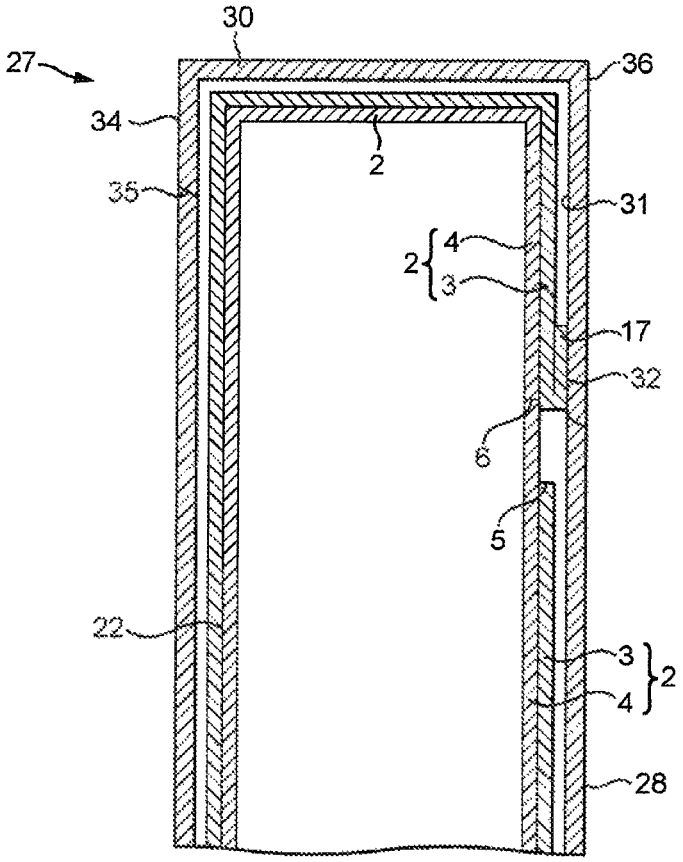
FIG. 8 shows a cross-section of a second example of a pack containing the wrapped bundle of FIG. 5, in a closed position.
Figure 9:
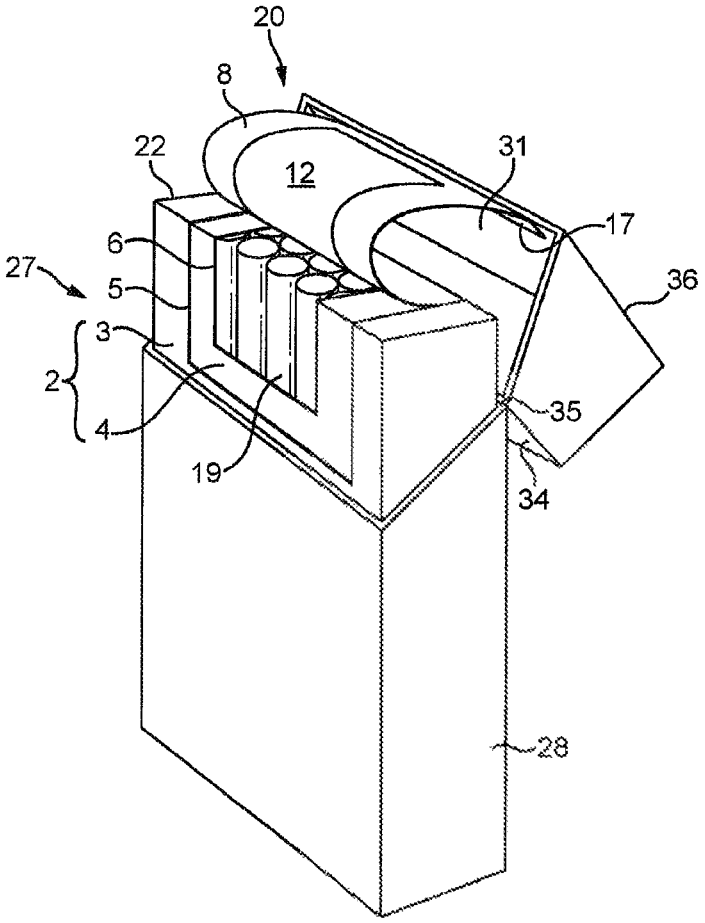
FIG. 9 shows another cross-section of the pack of FIG. 8, in an open position.

In a further embodiment, shown in FIGS. 8 and 9, the tab region 17 may be folded back on itself and adhered to the inside surface 31 of the lid 30. As shown in FIG. 8, the tab region 17 of the outer layer 3 has been folded back and adhered to the inside surface 31 of the lid 30.

Therefore, as the lid 30 is opened the lid 30 will pull on the first and second regions 8, 12 of the outer and inner layers 3, 4 to form a cover flap 20 and an opening 17 in the wrapper, as shown in FIG. 9. The cover flap 20 forms an outwardly convex shape, which is increased in size relative to the embodiment of FIGS. 6 and 7 due to the folded arrangement of the tab region 17.

This outwardly convex form of the cover flap 20 provides the gradual peeling and reattachment of the cover flap 20 as the lid 30 is opened and closed. If the wrapper 1 is provided with pressure sensitive adhesive, as previously described, this gradual peeling action ensures that the layers of the laminate material 2 are reattached to each other in the peripheral region 15 on closing the lid 30.

Figure 10:
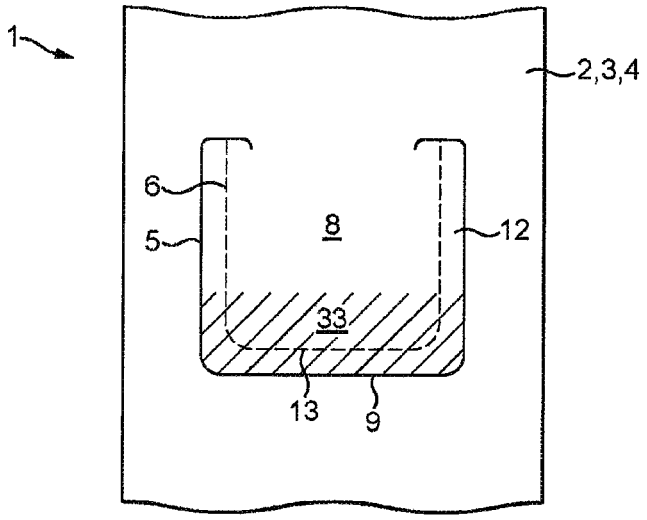
FIG. 10 shows another example of a wrapper.

In an alternative embodiment, shown in FIG. 10, the laminate material 2 may not have a defined tab region 17, and another part of the outer layer 3 may be adhered to the inside surface 31 of the lid 30. For example, the attachment between the outer layer 3 of the laminate 2 and the inside surface 31 of the lid 30 may be in the region 33 indicated in FIG. 10. The region 33 overlaps the first and second cuts 5, 6 such that the region of attachment at least partly overlies the first and second regions 8, 12 in the laminate material 2.

Figure 11:
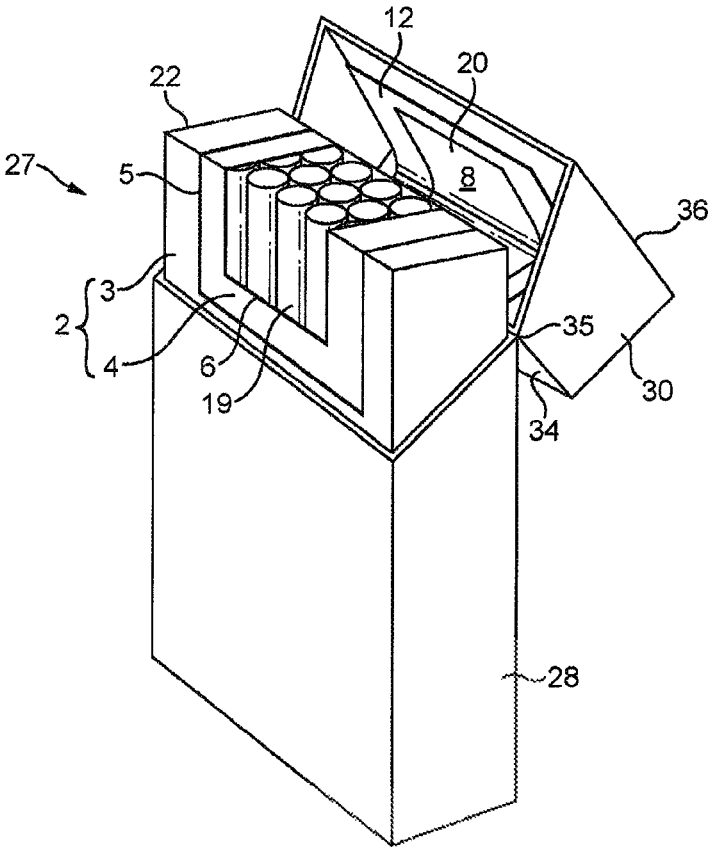
FIG. 11 shows a pack containing a wrapped bundle formed using the wrapper of FIG. 10.

In this case, the outer layer 3 does not have any way of folding or deforming as the lid 30 is opened and closed, meaning that the cover flap 20 would maintain an inwardly concave shape when the pack 27 is opened, as shown in FIG. 11.

In particular, because the laminate 2 is attached to the inside surface 31 of the lid 30 over a region 33 adjacent to the bottom edge 9 of the first region 8, the cover flap 20 is not peeled as the lid 30 is opened, but rather pulled from the remainder of the laminate material 2.

The inwardly concave form of the cover flap 20 may be advantageous for providing increased access to the opening 19 in the laminate 2 as the cover flap 20 is disposed entirely within the lid 30 when the lid 30 is open.

In each of the above described examples, the laminate material 2 is provided with adhesive between its layers 3, 4, 21. In one example, the inner layer 4 and the third layer 21 are permanently bonded together across their entire area, and the outer layer 3 is bonded to the third layer 21 by a pressure-sensitive adhesive across their entire area.

In other embodiments, the adhesive between the layers 3, 4, 21 of the laminate material 2 may be patterned.

Figure 12A:
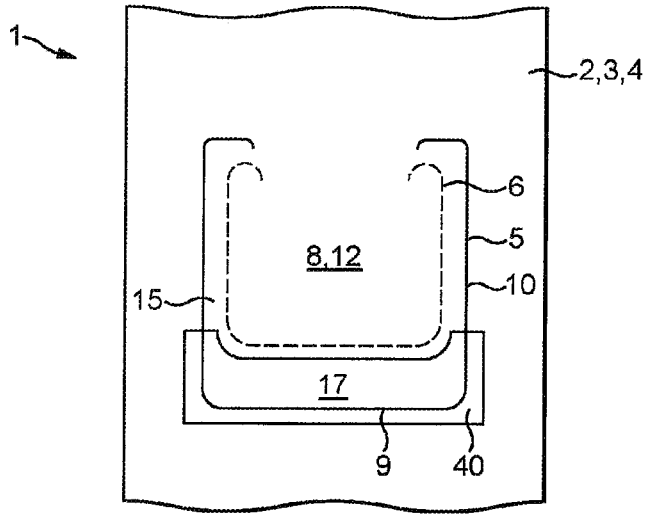
FIG. 12 shows an alternative wrapper, having patterned pressure sensitive adhesive.

FIG. 12*a* shows an alternative wrapper 1 having outer and inner layers 3, 4 with first and second cuts 5, 6, respectively, in the same manner as described with reference to FIGS. 1 and 2. In this case, the pressure sensitive adhesive provided between the inner and outer layers 3, 4 is patterned such that the tab region 17 of the laminate material 2 is not provided with pressure sensitive adhesive. In particular, region 40, as indicated in FIG. 12, is free from pressure sensitive adhesive between the inner and outer layers 3, 4.

As shown, this adhesive free region 40 overlaps the edges of the first region 8 (i.e. it extends past the first cut 5) to ensure that the tab region 17 is free from adhesive, regardless of small inaccuracies in printing the adhesive or aligning the features of the wrapper 1 that may arise due to manufacturing tolerances.

In this example, when the first and second regions 8, 12 are lifted to form the opening 19 (see FIG. 3) the laminate material 2 is still delaminated in the entire peripheral region 15, but the tab region 17 will require no force to delaminate because there is no pressure sensitive adhesive in this region.

As shown in FIG. 12*a*, in this example the pressure sensitive adhesive is arranged such that it completely surrounds the second cut 6—only the tab region 17 is free from pressure sensitive adhesive. In this way, the cover flap (20, see FIG. 3) can be reattached to the remainder of the laminate material 2 around the entire extraction opening.

However, in other embodiments the pressure sensitive adhesive may be patterned such that other regions of the laminate material 2 are also free from pressure sensitive adhesive, including other parts of the peripheral region 15.

Figure 12B:
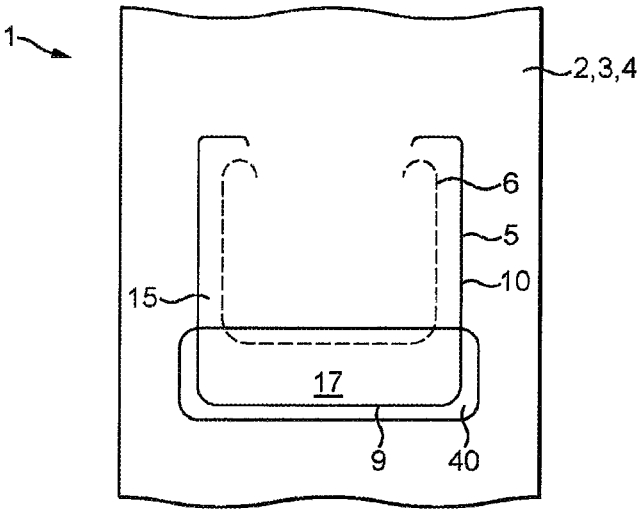

In an alternative example, shown in FIG. 12*b*, the adhesive free region 40 extends over the second cut 6. In this way, the pressure sensitive adhesive does not extend completely around the peripheral region 15. Such an arrangement will reduce the force required to open the cover flap 20 for the first time.

In other examples, areas of the laminate material 2 may be free from at least one of the adhesives, or the adhesive coating weight may vary across the area between the layers 3, 4, 21.

Figure 13:
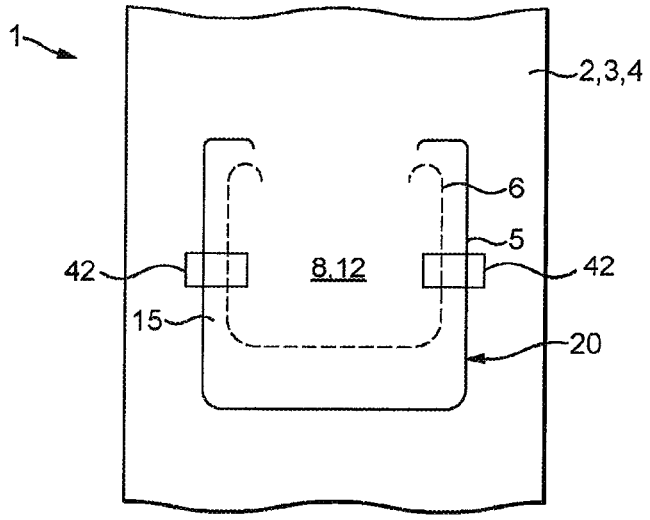
FIG. 13 shows a further alternative wrapper having patterned pressure sensitive adhesive.

As shown in FIG. 13, in another embodiment of the wrapper 1 the pressure-sensitive adhesive may also be omitted in regions 42 that correspond to the front edge 41 (see FIG. 5) of the wrapped bundle 22 (see FIG. 5). In this way, when the cover flap 20 is opened and closed it can smoothly move over the front edge 41 without becoming caught and deformed due to the adhesive.

Omitting the pressure sensitive adhesive in the front edge regions 42 can improve the opening and closing action of the cover flap 20 when the lid 30 is operated. When the lid 30 is opened, the adhesive free regions 42 ensure that the cover flap 20 rolls or peels away from the remainder of the laminate material 2 smoothly and easily, especially where the cover flap 20 extends across the front edge 41 of the wrapped bundle 22.

FIG. 13 shows two separate adhesive free front edge regions 42, one on either side of the opening (19, see FIG. 3). However, it will be appreciated that a single adhesive free region may be provided that extends across the width of the wrapper 1.

In other embodiments, the pressure sensitive adhesive may be omitted from other regions of the peripheral region 15 of the laminate material 2.

It will also be appreciated that only the pressure sensitive adhesive is omitted in these regions 42, and the permanent adhesive between the other layers of the laminate material 2 remains.

Figure 14:
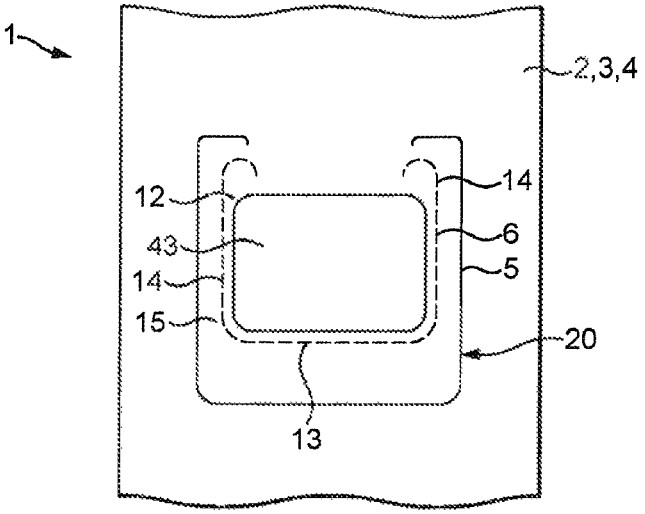
FIG. 14 shows a further alternative wrapper having patterned permanent adhesive; and, FIG. 15 shows a further alternative wrapper having patterned permanent adhesive.

In another embodiment, shown in FIG. 14, the laminate material 2 may be provided with a permanent adhesive region 43 in the second region 12, in particular between the two layers that form the cover flap 20 (i.e. between the outer layer 3 and third layer 21 in the example shown in FIG. 4*b*).

In this way, the second region 12 is prevented from coming detached from the cover flap 20 during opening and closing of the cover flap 20.

As shown in FIG. 14, the permanent adhesive region 43 may be slightly offset from the edges 13, 14 of the second cut 6 to ensure that the permanent adhesive region 43 does not extend over any edge 13, 14 of the second cut 6 and into the peripheral region 15. If the permanent adhesive region 43 extended into the peripheral region 15 then additional force would be required to delaminate the laminate material 2 in the peripheral region 15, making the wrapper 1 more difficult to open.

In another embodiment, the pressure sensitive adhesive provided between the outer and inner layers 3, 4 of the laminate material 2 may be patterned such that the second region 12 of the laminate material 2 is provided with an increased coating weight of pressure sensitive adhesive compared to the remainder of the laminate material 2.

This region of pressure sensitive adhesive having increased coating weight would be provided in the same region 43 described with reference to FIG. 14.

This increased pressure sensitive adhesive coating weight will provide a stronger bond and help to prevent the second region 12 becoming detached from the outer layer 3 when the cover flap 20 is opened.

The coating weight of the pressure sensitive adhesive is determined by the process of printing the adhesive to the film during lamination of the laminate material 2. For example, the pressure sensitive adhesive may be gravure printed onto one of the outer layer 3 with varying coating weights across its area prior to be laminated to the other layer.

Figure 15:
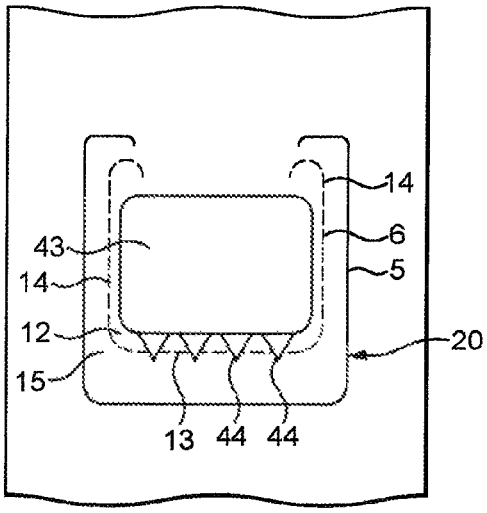

Alternatively, as shown in FIG. 15, the permanent adhesive region 43 may be patterned with a series of zig-zag shaped protrusions 44 extending towards to bottom edge 13 of the second cut 6.

In this way, if the alignment between the first and second cuts 5, 6 and the permanent adhesive region 43 is slightly inaccurate then the amount of the permanent adhesive region 43 that lies within the peripheral region 15 is limited to only a small area defined by the points of the zig-zag shaped protrusions 44. Therefore, the peripheral region 15 can still be delaminated on opening the cover flap 20 as minimal additional force will be required to break the small amount of overlapping permanent adhesive.

It will be appreciated that zig-zag shaped protrusions 44 similar to those described above may also or alternatively extend from the permanent adhesive region 43 towards the side edges 14 of the second cut 6.

It will also be appreciated that if the laminate material 2 is provided with a region of pressure sensitive adhesive having an increased coating weight, as described above, then the zig-zag protrusions 44 described with reference to FIG. 15 may be zig-zag protrusions 44 of pressure sensitive adhesive having an increased coating weight. The region of increased coating weight will provide a stronger bond between the outer and inner layers 3, 4 in that location, while the zig-zag protrusions 44 will limit the overlap between the region of increased coating weight and the peripheral region 15.

It will be appreciated that the laminate material 2 of the wrapper 1 may be provided with any combination of the adhesive patterns described with reference to FIGS. 8 and 13 to 15.

In one particular example, the laminate material 2 is provided with the pressure sensitive adhesive free region 40 of FIG. 8 as well as the permanent adhesive region 43 of FIG. 14 or FIG. 15. In addition, the laminate material 2 may optionally comprise the pressure sensitive adhesive free regions 42 of FIG. 13.

In the above described embodiments the pack 27 may be manufactured by first wrapping the tobacco industry products in the wrapper 1 to form a wrapped bundle 22 and then folding the pack base portion 28 and lid 30 around the wrapped bundle 22. After wrapping the wrapped bundle 22 but before forming the lid 30 around the wrapped bundle 22 permanent adhesive may be provided on the portion of the laminate material 2 to be attached to the inside surface 31 of the lid 30. Therefore, when the lid is folded against the wrapped bundle 22 the permanent adhesive will join the relevant portion of the laminate material 2 to the inside surface 31 of the lid 30.

As used herein, the term "smoking article" includes smokeable products such as cigarettes, cigars and cigarillos whether based on tobacco, tobacco derivatives, expanded tobacco, reconstituted tobacco or tobacco substitutes. The pack described herein may also be used for tobacco heating products (THPs), also referred to as heat-not-burn (HnB) products, and other nicotine delivery product such as aerosol generation devices including e-cigarettes. In particular, the pack may be used to package consumables for THPs or e-cigarettes. The smoking article may be provided with a filter for the gaseous flow drawn by the smoker.

A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and tobacco heating devices (THDs), also referred to as heat-not-burn (HnB) products; and c) other nicotine-delivery systems such as inhalers, aerosol generation devices including e-cigarettes, lozenges and gum. This list is not intended to be exclusive, but merely illustrates a range of products which are made and sold in the tobacco industry.

In order to address various issues and advance the art, the entirety of this disclosure shows by way of illustration various embodiments in which the claimed invention(s) may be practiced and provide for a superior pack for tobacco industry products. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A pack comprising a group of tobacco industry products wrapped in a laminate to form a bundle, a base containing the bundle, and a lid mounted to the base for rotation between an open position and a closed position, the laminate comprising an outer layer having a first cut that defines an outer layer region bounded by said first cut and, an inner layer having a second cut that defines an inner layer region bounded by said second cut, the inner layer region lying within the outer layer region, wherein a part of the outer layer region is attached to an inside surface of the lid such that, as the lid is rotated into its open position, the inner and outer layer regions are lifted causing the inner and outer layers to delaminate in a peripheral region between the first and second cuts and an opening to be created in the laminate, wherein the laminate further comprises:

a pressure-sensitive adhesive between the inner layer and the outer layer such that said peripheral region re-adheres when the lid is rotated into its closed position, and an adhesive-free region between the inner layer and the outer layer that extends over the first and second cuts.

2. The pack of claim 1, wherein a portion of the laminate corresponding to the part of the outer layer region that is attached to the inside surface of the lid is free of pressure sensitive adhesive.

3. The pack of claim 1, wherein the bundle comprises an edge over which the first and second cuts extend such that the opening is formed over said edge, a region of the laminate corresponding to said edge being free of pressure sensitive adhesive.

4. The pack of claim 1, wherein the inner and outer layer regions are attached using a permanent adhesive.

5. The pack of claim 1, wherein an outer surface of the outer layer region is attached to the inside surface of the lid.

6. The pack of claim 1, wherein the part of the outer layer region that is attached to the inside surface of the lid is folded to form a tab and an inner surface of said tab is attached to the inside surface of the lid.

7. The pack of claim 6, wherein the outer layer region comprises a fold line along which the tab can flex relative to the remainder of said outer layer region.

8. The pack of claim 1, wherein the inner and outer layers comprise orientated polypropylene.

9. The pack of claim 1, wherein the laminate comprises a third layer, disposed between said inner and outer layers, and wherein either the first cut or the second cut extends through the third layer.

10. The pack of claim 9, wherein the third layer comprises metal foil.

11. The pack of claim 1, wherein the part of the outer layer region that is attached to an inside surface of the lid is arranged such that the inner and outer layer regions that are lifted when the pack is opened form an outwardly convex shape.

12. The pack of claim 1, wherein the part of the outer layer region that is attached to an inside surface of the lid is arranged such that the inner and outer layer regions that are lifted when the pack is opened form an inwardly concave shape.

13. The pack of claim 1, wherein the first and second cuts are formed by lasers.

14. A method of producing a pack comprising the steps of:

wrapping a laminate about a group of tobacco industry products to form a bundle, said laminate comprising an inner layer and an outer layer, the outer layer having a first cut that defines an outer layer region, and the inner layer having a second cut that defines an inner layer region that lies within the outer layer region;

wherein the laminate comprises a pressure-sensitive adhesive between the inner layer and the outer layer such that said peripheral region re-adheres when the lid is rotated into its closed position, and an adhesive-free region between the inner layer and the outer layer that extends over the first and second cuts;

inserting said bundle within a base having a lid mounted to the base for rotation between open and closed positions; and attaching a part of the outer layer region to an inside surface of the lid.

15. The method of claim 1, further comprising the step of cutting the laminate to define the first and second cuts prior to wrapping the laminate about the group of tobacco industry products.

16. The method of claim 1, wherein the cutting is performed using a laser.

17. The method of claim 1, wherein the step of attaching a part of the outer layer region to an inside surface of the lid comprises providing said part with an adhesive coating prior to folding a blank about the bundle to form the lid.

* * * * *